US006366249B1

(12) United States Patent
Jones et al.

(10) Patent No.: US 6,366,249 B1
(45) Date of Patent: Apr. 2, 2002

(54) RADIO FREQUENCY ANTENNA

(75) Inventors: Dennis P Jones, Farmington Hills; Daniel J Forest, Macomb, both of MI (US)

(73) Assignees: General Motors Corporation, Detroit; Delphi Technologies, Inc., Troy, both of MI (US)

( * ) Notice: Subject to any disclaimer, the term of this patent is extended or adjusted under 35 U.S.C. 154(b) by 0 days.

(21) Appl. No.: 09/654,644

(22) Filed: Sep. 5, 2000

(51) Int. Cl.[7] ..... H01Q 1/32
(52) U.S. Cl. ..... 343/715; 343/703; 343/850
(58) Field of Search ..... 343/850, 749, 343/711, 713, 715, 738, 739, 703; H01Q 1/32

(56) References Cited

U.S. PATENT DOCUMENTS 4,890,116 A * 12/1989 Lewis ..... 343/749
5,111,213 A * 5/1992 Jahoda et al. ..... 343/738

* cited by examiner

*Primary Examiner*—Michael C. Wimer
(74) *Attorney, Agent, or Firm*—Anthony Luke Simon

(57) ABSTRACT

A vehicle antenna comprising: an antenna structure having an input impedance, $Z_A$, equal to a sum of a resistance and an active impedance; a circuit element having high circuit element impedance at an operating frequency range of the antenna, wherein the circuit element is coupled in parallel with the input impedance.

1 Claim, 3 Drawing Sheets

RADIO FREQUENCY ANTENNA

TECHNICAL FIELD

This invention relates to a radio frequency antenna.

BACKGROUND OF THE INVENTION

Many communications systems for vehicles require an antenna mounted to the vehicle. For example, vehicle radios have conventional antennas, either fixed or retractable. Vehicle cellular communication devices often have a vehicle-mounted antenna.

It is known to mount radio or cellular antennas in or to a glass window of a vehicle. Certain glass-mounted antennas have impedance matching networks that have a low DC resistance to allow diagnostic detection of whether the antenna is properly connected to the cellular transceiver.

Referring to FIG. 1, the diagram illustrates the input impedance of an example quarter wave antenna 10 of a known type for receiving cellular communications to a vehicle. The input impedance is represented by a resistive component 12 in series with an active element 14. The impedance $Z_A$ of the antenna is the sum of $R_A$ and $X_A$, and is not suitable for provide a test signal to the antenna signal output because the antenna typically appears as an open circuit. Thus it is not possible for the transceiver to use a test signal to determine whether the antenna is connected to the transceiver.

FIG. 2 illustrates an example antenna 10 known in the art and includes an internal base 22 mounted on the interior side of a vehicle body member 27 (such as a planar or curved roof panel or glass windshield). On the exterior side of vehicle body member 27 is the external extending portion 20 of the antenna 10. The external extending portion 20 is connected to the internal base 22 by a mounting screw (not shown) so that the two sandwich the vehicle body member 27. An RF connector 24 for an antenna feed transmission cable (not shown) is connected through a radio frequency signal connection to the internal base 22. An access hole 26 is provided opposite the mounting screw from the connector 24. Within the internal base 22 are structures that are coupled to the antenna ground and signal output.

SUMMARY OF THE INVENTION

Advantageously, this invention provides an improved antenna suitable for mounting on a vehicle.

Advantageously, this invention provides an improved antenna that can be remotely monitored to ensure that it is correctly connected.

Advantageously, according to a preferred example, this invention provides a vehicle antenna comprising: an antenna structure having an input impedance, $Z_A$, equal to a sum of a resistance and an active impedance; and a circuit element having high circuit element impedance at an operating frequency range of the antenna, wherein the circuit element is coupled in parallel with the input impedance.

BRIEF DESCRIPTION OF THE DRAWINGS

The present invention will now be described by way of example with respect to the following drawings, in which.

DESCRIPTION OF THE PREFERRED EMBODIMENT

Figure 1:
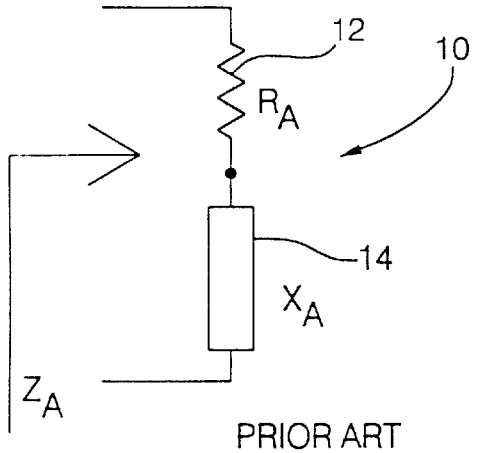
PRIOR ART FIG. 1
FIG. 1 is an example prior art antenna circuit.
Figure 2:
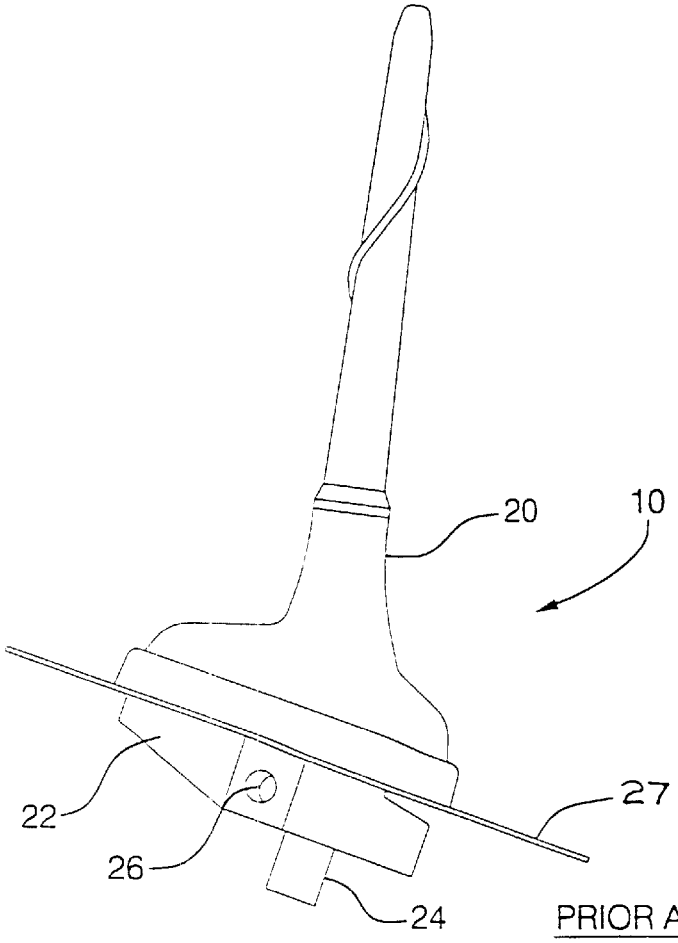
PRIOR ART FIG. 2
FIG. 2 is an example prior art antenna.
Figure 3:
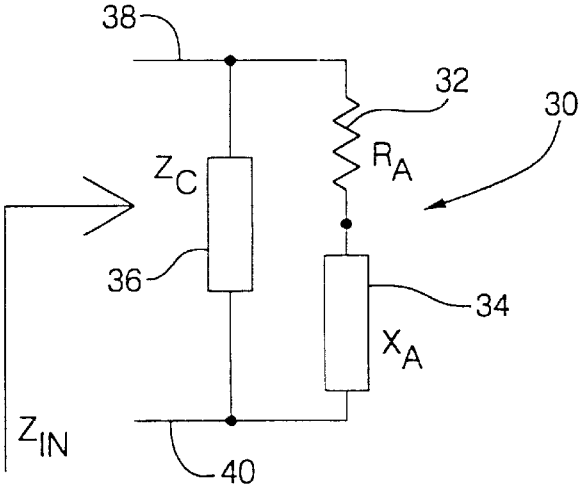
FIG. 3 is an example antenna circuit according to this invention.

Referring now to FIG. 3, the antenna 30 has DC characteristics that have been altered when compared to the antenna 10 of FIG. 1 while the RF characteristics have remained substantially unchanged. This is achieved by tuning the impedance of the antenna by adding circuit element (s) 36 in parallel with the antenna's RF circuit represented by resistance 32 and active component 34.

More particularly, the input impedance of an antenna is given as $$Z_A=R_A+JX_A,$$

where $Z_A$ is the antenna impedance at the output terminals 38, 40 of the antenna (without element 36), $R_A$ is the antenna resistance at the output terminals 38, 40 and $X_A$ is the antenna reactance at the output terminals 38, 40. At DC, an example quarter wave cellular frequency antenna has an $R_A$ equal to infinity and thus appears as an open circuit.

With the addition of circuit element 36 having impedance $Z_C$, the input impedance of the antenna is now modified as $$ZIN=ZC||ZA$$

The value of $Z_C$ must either be resistive or be a short circuit at DC to allow remote diagnostic of the connection of the feed transmission cable. That is, to allow a remote low voltage test signal to determine whether the transmission feed cable is connected to the antenna, circuit element 36 must create a dc path across the antenna. Additionally, the value $Z_C$ must be high at the desired RF frequency so that normal operation of the antenna is not altered.

Two different circuit elements fit these criteria. One is an inductor, which has an impedance of:

$$Z_C=j2\pi fL,$$

where f is the frequency in Hz and L is the inductance in Henries. At DC (f=0 Hz) an ideal inductor has zero impedance and looks like a short circuit. The impedance increases linearly with frequency. By choosing an inductor sufficiently high impedance at the operating frequency of the antenna, the normal operation of the antenna will not be affected.

The other possible circuit element 36 is a resistor with an impedance of $$Z_C=R$$

where R is the resistance (Ω). The circuit becomes a current divider. Since it is desired to have nearly all of the power received by the antenna, either from the air or from the transmission feed cable, pass through the antenna from transmission or reception purposes, the resistor value is chosen to be high enough so that return loss is minimized. This ensures that the current divider ratio is heavily in favor of the antenna.

In an example implementation, given an antenna that is perfectly matched at 824 MHz, either a resistor or an inductor can be used that will add DC continuity to the antenna for diagnostic purposes while maintaining a return loss ($|S_{11}|$) of 0.01. In this example, the input frequency fis 824 MHz, the output impedance of the antenna is 50 Ωand the impedance of the RF portion of the antenna (represented by elements 32 and 34 in series) is also 50 Ω. The input impedance is given by:

$$Z_{IN}=Z_A \| Z_C=Z_A Z_C/(Z_A+Z_C)$$

And the return loss is give by:

$$S_{11}=(Z_{IN}-Z_0)/(Z_{IN}+Z_0)$$

If the return loss is set to 0.01, solving for $Z_{IN}$ yields $|Z_{IN}|=49\ \Omega$. Then solving for $Z_C$ yields $|Z_C|=2475\ \Omega$. At the desired frequency, either a resistor of R=2.475 KΩ or an inductor of L=0.478 $\mu$H is suitable as the added circuit element 36. This is only one example and it will be understood that this for any give operating frequency f and antenna output impedance, the above process can be used to determine the desired resistance or inductance of the circuit element 36.

Figure 4:
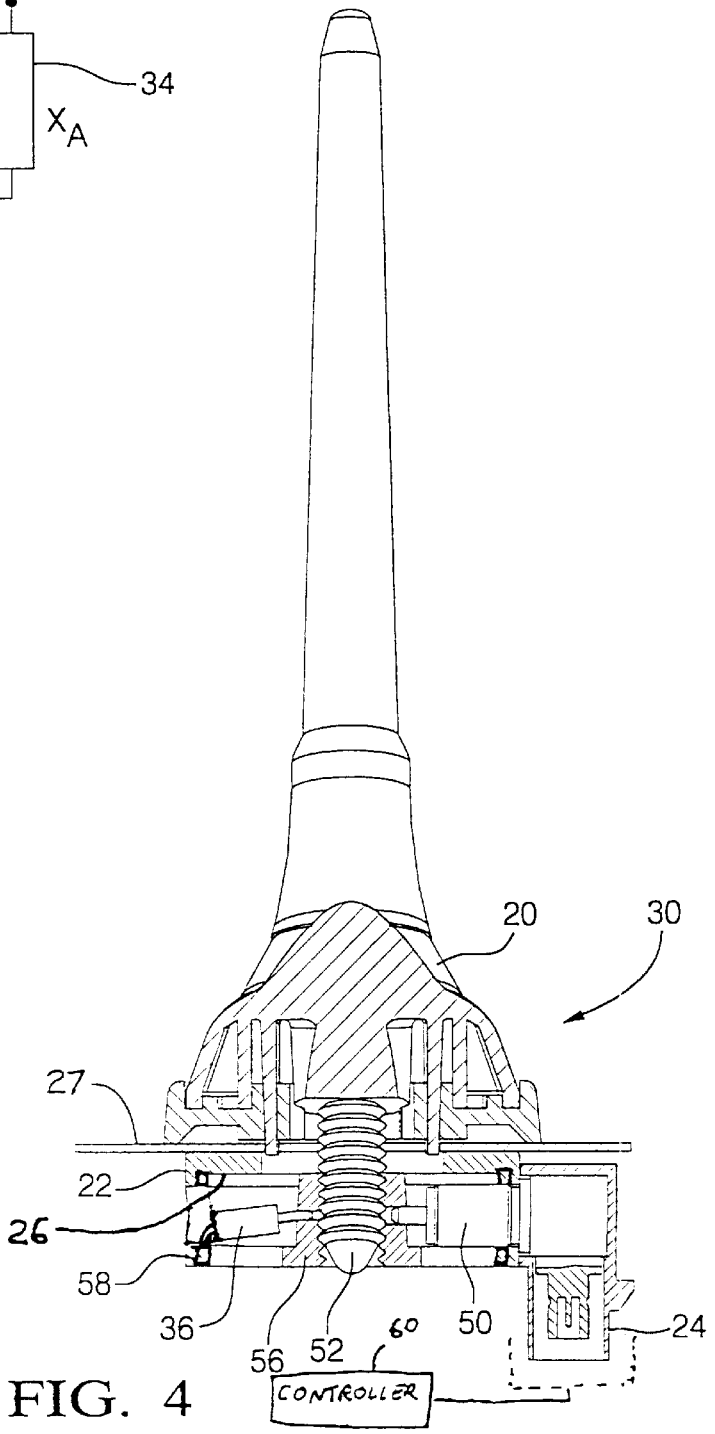
FIG. 4 is an illustration of an example of this invention.

FIG. 4 illustrates an example of how the antenna in FIG. 1 can be modified to achieve the advantages of this invention. The internal base 22 is mounted on the interior side of a vehicle body member 27. On the exterior side of vehicle body member 27 is the external extending portion 20 of the antenna 10. The external extending portion 20 is connected to the internal base 22 by a mounting screw 52 so that the two sandwich the vehicle body member 27. The antenna feed transmission cable 25 is connected through radio frequency signal connector 24 of a known type to the internal base 22. An access hole 26 is provided opposite the mounting screw from the male RF connector 24. Within the internal base 22 is a peripheral metal body structure 58 that is coupled to antenna ground and bushing 56 for the mounting screw 52 which receives the RF signal output. The element 36, either a resistor or inductor or some other structure with the same electrical properties as a resistor or inductor, is located within the chamber provided by the access hole 26 and is electrically connected between the bushing 56 and the peripheral metal body structure 58. It is understood that with the exception of the element 36 and its connection into the antenna 30, the components of the antenna 30 are identical to like components in the prior art antenna 10 and are not considered part of this invention.

Figure 5:
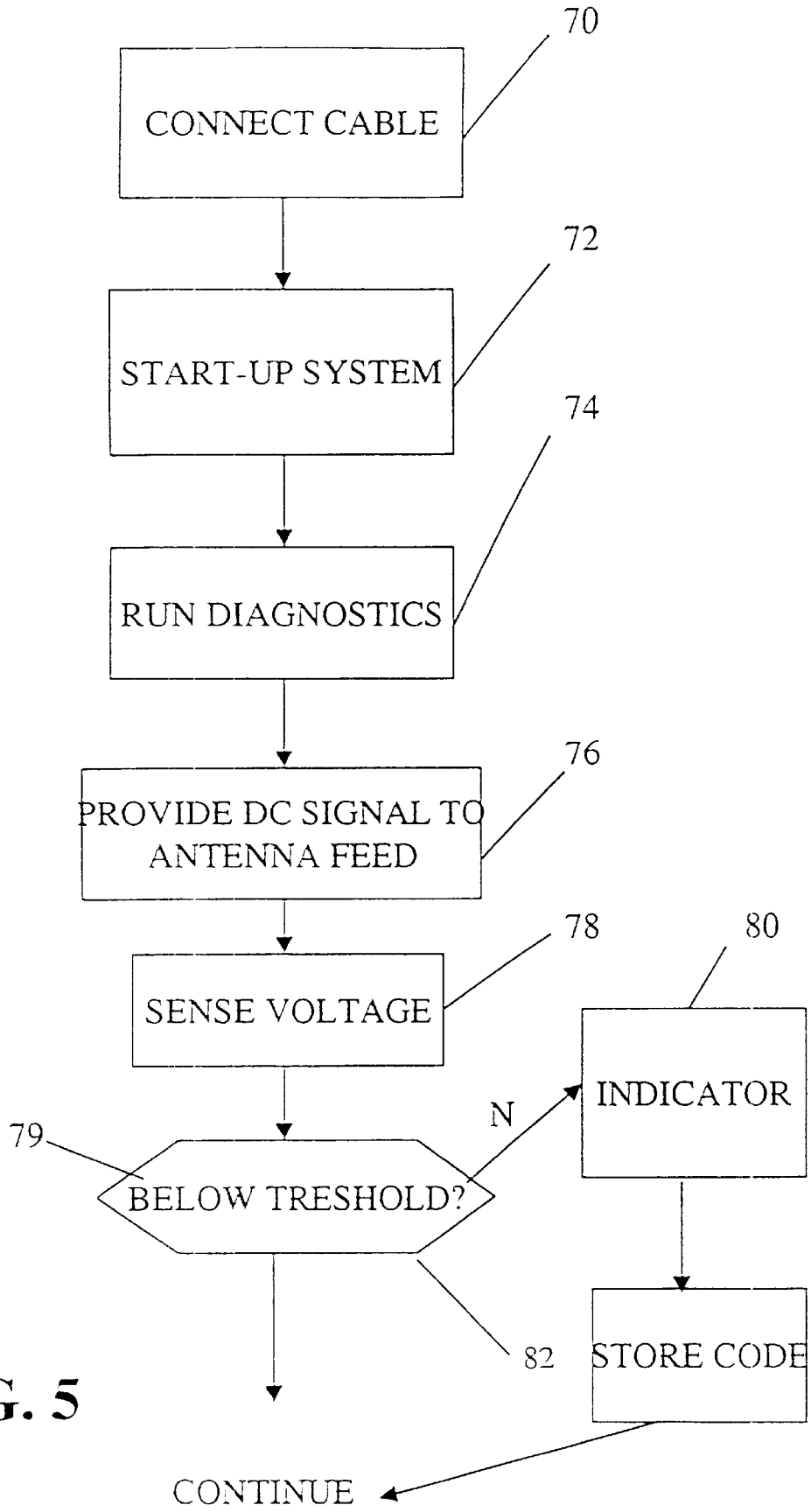
FIG. 5 illustrates an example method of this invention.

Referring now also to FIG. 5, an example method according to this invention includes connecting the signal feed transmission cable 25 to the antenna 30 (block 70). Next the controller 60 starts (block 72) and runs the diagnostics suitable for the controller 60 and the cellular transceiver (block 74). Blocks 76–82 illustrate example diagnostic steps performed by controller 60. At block 76, the controller 60 provides a DC signal through the transmission feed cable 25 to the antenna 30. At block 78 the controller senses the voltage of the DC signal and block 79 compares the sensed voltage to a threshold. If the voltage is too high, it indicates an open circuit, which in turn indicates that the transmission feed cable 25 is likely not connected to the antenna 30. If the voltage is not below the threshold, then block 80 sends a signal to turn on an indicator, either as part of the cellular transceiver system or a telltale in the vehicle instrument panel, to alert the vehicle operator that a repair may be necessary. Then block 82 stores a code in controller 60 memory to allow diagnostic of the potential issue—antenna transmission feed cable disconnected.

What is claimed is:

1. A vehicle antenna comprising:

an antenna structure having an input impedance, $Z_A$, equal to a sum of a resistance and an active impedance;

a resistor having high impedance at an operating frequency range of the vehicle antenna, wherein the resistor is coupled in parallel with the input impedance;

an internal base including an opening, wherein the resistor is located within the opening, wherein the opening contains a ground connection connected to a first end of the resistor and an antenna output connection connected to a second end of the resistor;

a mounting screw for connecting the internal base to an external extending portion of the antenna, wherein a substantially planar vehicle structure is located between the internal base and the external extending portion;

a bushing in the internal base receiving the mounting screw and connected to the resistor, wherein the bushing comprises the antenna output connection connected to the resistor; and an RF connector attached to the internal base and coupled to the antenna output connection and the resistor, wherein the resistor creates an electrical path to ground for a connection cable if a connection cable is properly coupled to the RF connector and wherein the resistor is electrically isolated from the connection cable if the connection cable is not coupled to the RF connector, allowing de diagnostics of whether the connection cable is properly coupled to the RF connector.

* * * * *